US006050907A

United States Patent [19]

Long

[11] Patent Number: 6,050,907

[45] Date of Patent: Apr. 18, 2000

[54] APPARATUS AND METHOD FOR PRACTICING HITTING A BASEBALL

[76] Inventor: Thomas L. Long, 6243 N. Casa Blanca, Paradise Valley, Ariz. 85253

[21] Appl. No.: 09/079,823

[22] Filed: May 15, 1998

[51] Int. Cl.[7] ..... A63B 43/00; A63B 69/00

[52] U.S. Cl. ..... 473/453; 473/451; 473/614

[58] Field of Search ..... 473/422, 451, 473/453, 577, 569, 594, 614

[56] References Cited

U.S. PATENT DOCUMENTS

| | | | |
|---|---|---|---|
| 1,557,751 | 10/1925 | Winks | 473/577 |
| 2,591,016 | 4/1952 | Schoenherr | 473/569 X |
| 3,114,550 | 12/1963 | Hughes | 473/594 X |
| 3,262,700 | 7/1966 | Miller | 473/594 X |
| 5,820,495 | 10/1998 | Howland | 473/451 |

*Primary Examiner*—Raleigh W. Chiu
*Attorney, Agent, or Firm*—Tod R. Nissle, P.C.

[57] ABSTRACT

A method and apparatus for practicing hitting a ball with a striking instrument. The apparatus comprises a ball having a portion which extends outwardly from the spherical body of the ball and which is driven into the ball when the ball is struck correctly with a striking instrument.

16 Claims, 2 Drawing Sheets

FIG. 1
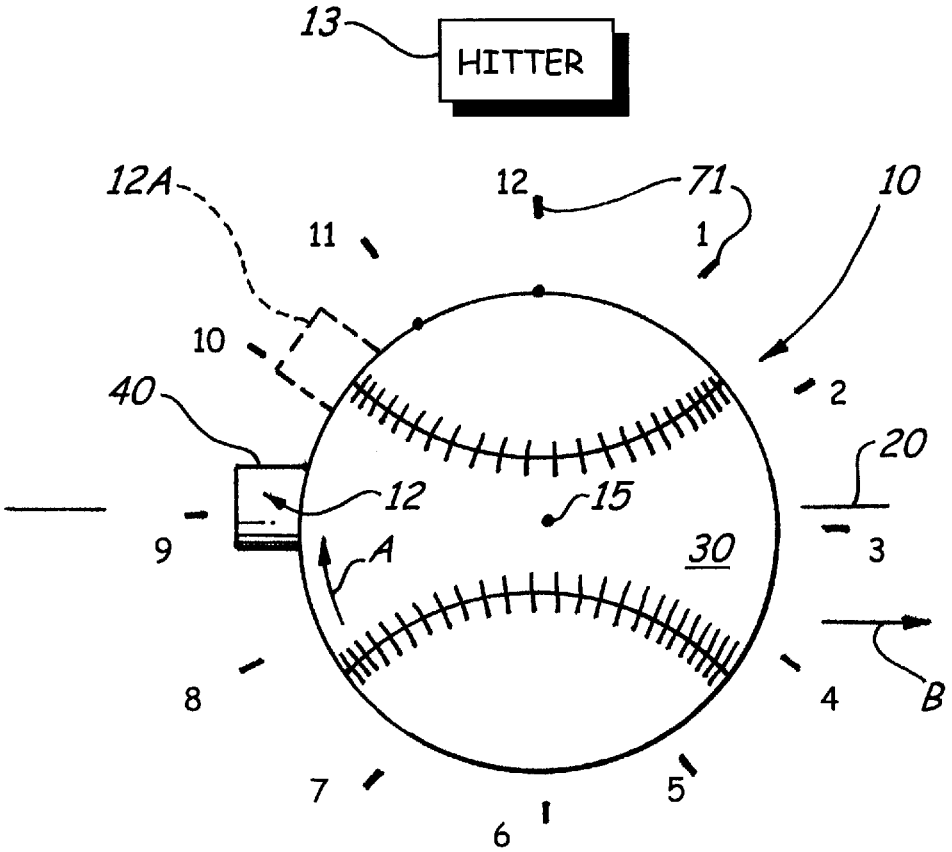
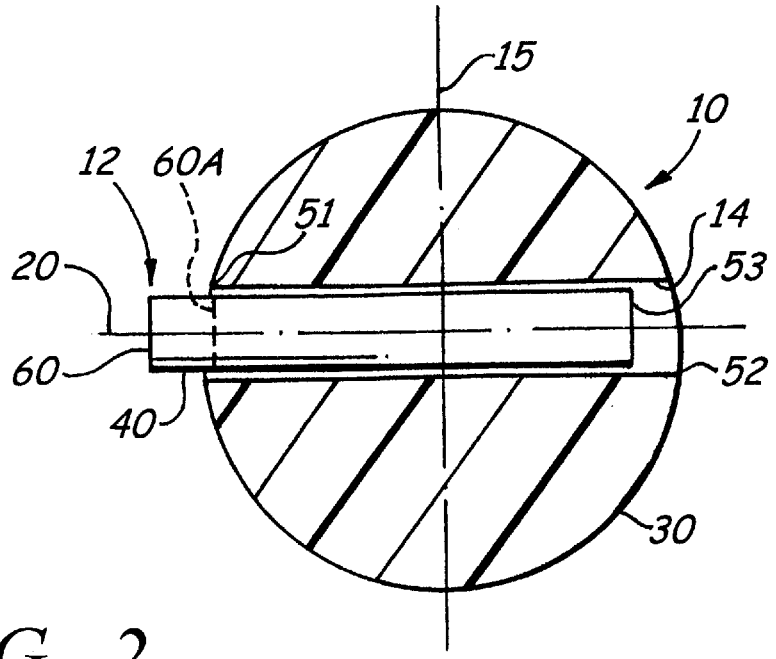
FIG. 2

FIG. 3
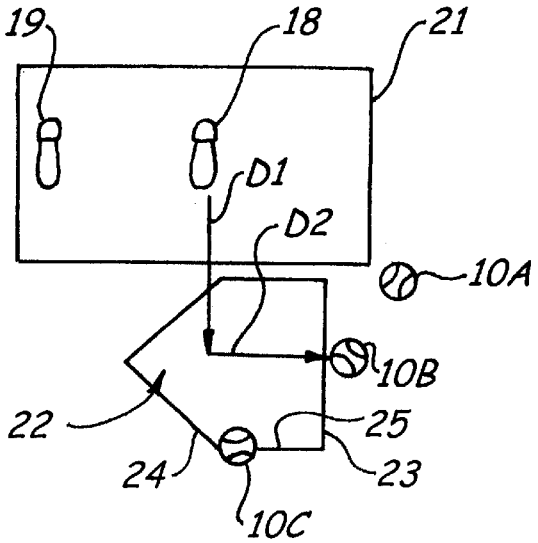
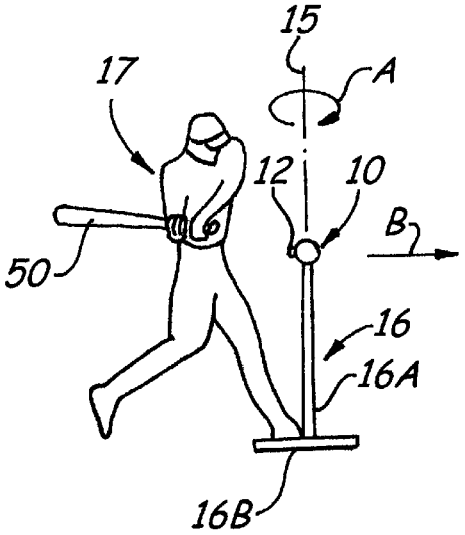
FIG. 4

APPARATUS AND METHOD FOR PRACTICING HITTING A BASEBALL

This invention relates to games in which a ball is hit with a bat, racket, paddle, club or other instrument for striking the ball.

More particularly, the invention relates to a method and apparatus for learning a technique for hitting a ball with a selected striking instrument.

In a further respect, the invention relates to a ball including apparatus which enables an individual to determine whether the ball has been hit at a particular point by a striking instrument.

Equipment for practicing hitting a baseball has existed for many years. For example, batting cages are equipped with a pitching mound which permits a pitcher to throw a baseball to a hitter in the batting cage. Batting cages are also equipped with mechanical devices which "throw" a ball toward a hitter in the batting cage. A batting-T is another long existing piece of equipment used by a hitter to practice hitting a baseball. A batting-T consists of a base which sets on the ground and of a telescoping post which is connected and normal to the base and which extends upwardly from the base. The length of the telescoping post is adjusted as desired. A baseball is placed on the upper distal end of the post and is hit with a bat by a batter who is practicing his hitting technique. I have discovered that one disadvantage of such conventional equipment is that a batter is never certain where he makes contact with the ball. Those of skill in the art apparently have never recognized and focused on this problem. As a result, it becomes difficult to develop a proper swing which can consistently be replicated over and over again, particularly under the stress encountered during an actual baseball game or other game in which a striking instrument is utilized to contact a ball.

Therefore, it is a principal object of the invention to provide an improved method and apparatus for contacting a ball with a ball-striking instrument.

A further object of the invention is to provide an improved method and apparatus of the type described which enables an individual readily to determine whether he has contacted a ball at a desired location on the ball.

These and other, further and more specific objects and advantages of the invention will be apparent to those skilled in the art from the following detailed description thereof, taken in conjunction with the drawings, in which:

FIG. 1 illustrates a baseball constructed in accordance with the principles of the invention;

FIG. 2 is a section view of the baseball of FIG. 1 further illustrating construction details thereof;

FIG. 3 is a top view illustrating the preferred position of a baseball during an inside pitch, during a pitch down the middle, and during an outside pitch when the batter strikes the ball; and, FIG. 4 is a front elevation view of a batter and a batting-T illustrating the method of the invention.

Briefly, in accordance with my invention, I provide an improved practice ball for enabling an individual contacting the ball with a striking instrument to determine whether the striking instrument contacts the ball at a desired location. The practice ball includes a spherically shaped body; and, at least one arm mounted on the body. The arm is moveable between at least two operative positions, a first operative position with at least a portion of the arm extending outwardly from the body, and a second operative position with the arm displaced from the first operative position. The arm is displaced from the first to the second operative position by hitting the portion of the arm extending outwardly from the body with the striking instrument.

In another embodiment of the invention, I provide an improved method for practicing hitting a ball. The method includes the step of providing a practice ball. The practice ball includes a spherically shaped body and at least one arm mounted on the body. The arm is moveable between at least two operative positions, a first operative position, and a second operative position with the arm displaced from the first operative position.

The improved method also includes the step of providing a striking instrument for hitting the practice ball. The arm extending is displaced from the first to the second operative position by hitting the arm with the striking instrument.

The improved method also includes the steps of placing the practice ball in a fixed position with the arm in the first operative position; hitting the practice ball with the striking instrument while attempting to hit the arm with the striking instrument; and, after hitting the practice ball with the striking instrument, examining the practice ball to determine if the arm is displaced from the first to the second operative position.

In a further embodiment of my invention, I provide an improved practice ball for enabling an individual contacting the ball with a striking instrument to determine whether the striking instrument contacts the ball at a desired location. The practice ball includes a spherically shaped body; and, at least one arm mounted on the body. The arm is moveable between at least two operative positions, a first operative position, and a second operative position with the arm displaced from the first operative position. The arm is displaced from the first to the second operative position by hitting the arm with the striking instrument.

Turning now to the drawings, which depict the presently preferred embodiments of the invention for purposes of illustrating the invention and not by way of limitation of the scope of the invention, FIG. 1 illustrates a practice baseball 10 constructed in accordance with the invention and including a spherical body 30 and an elongate cylindrical arm 12 mounted on body 30 via cylindrical opening 14 formed in and through body 30. A portion 40 of arm 12 extends outwardly from body 30. Opening 14 and pin 12 are presently constructed such that pin 12 slidably frictionally engages the inner cylindrical surface of opening 14 such that when an individual strikes portion 40 with a bat traveling at a normal speed, portion 40 is driven completely into body 30 and opening 14 but pin 12 is not driven completely out of opening 14 and ball 10. If the practice baseball 10 is being used by an adult, the frictional engagement of pin 12 with the inner surface of opening 14 is preferably greater than the frictional engagement of pin 12 with the inner surface of opening 14 when the practice baseball 10 is being utilized by a child. The degree of frictional engagement and the distance portion 40 is displaced (regardless of whether portion 40 is displaced into an opening 14 or is otherwise displaced) can be adjusted as desired.

Arm 12 can have a circular cross section (i.e., arm 12 can be cylindrical), have a square or rectangular cross section, have an octagonal cross section, be hollow, or have any desired shape and dimension. By way of example, and not limitation, arm 12 may be threaded like a bolt or screw so that the outer edges of the threads dig into and frictionally engage the surface of opening 14.

Similarly, opening 14 can have any desired shape and dimension. Opening 14 need not, if desired, extend completely through spherical body 30. Opening 14 can taper, and the cross-section of opening 14 can vary as desired along its length. Any apparatus can be utilized in place of or in conjunction with opening 14 to house and control the movement of arm 12. By way of example, and not limitation, a set screw can extend into opening 14 to engage frictionally arm 12. Adhesive or VELCRO (TM) fastener can be placed in opening 14 to engage frictionally arm 12.

Portion 40 can constitute the entire length of arm 12 and can be utilized with or without opening 14. In the event opening 14 is omitted, portion 40 can be glued or otherwise adhered to the outer spherical surface of body 30, in which case portion 40 is, when struck by a bat, displaced by being deformed and/or driven into body 30.

If desired, means other than arm 12 and/or portion 40 can be utilized to determine when a selected area or point on ball 10 is hit with a bat or other striking instrument. For example, an area on the outer surface of ball 10 may change color when struck by a bat. Or, a pressure sensor(s) or other sensor(s) placed on or in body 30 can transmit a signal when the surface of body 30 near the sensor is struck by a bat. Or, a sensor in or on body 30 may be able to monitor all or a portion of the spherical surface of body 30 and determine at what point a bat strikes ball 10, regardless of whether or not the point at which the bat strikes ball 10 is adjacent the sensor.

While FIGS. 1 and 2 illustrate the use of the invention in conjunction with a baseball, those of skill in the art will appreciate that the invention can be incorporated in golf balls, cricket balls, tennis balls, and other balls utilized in games where a bat, club, racket, or other striking instrument is utilized to hit a ball. In addition, while the invention can be incorporated into balls actually used during the game by, for example, drilling an opening 14 in a baseball and gently pounding in an arm 12, the invention can also be incorporated in whiffle balls or any other generally spherical ball of any diameter constructed for the purpose of enabling an individual to practice hitting a ball with a striking instrument.

FIG. 1 is a top view of practice ball 10. FIG. 2 is a side section view of the practice ball 10 of FIG. 1. Vertical axis 15 extends through the center of ball 10. Ball 10 can, if desired, be rotated about axis 15 in the clockwise direction indicated by arrow A. Horizontal axis 20 extends through the center of ball 10 and is coincident with the center lines of cylindrical arm 12 and cylindrical opening 14.

In FIG. 1, reference rules or lines 71 are drawn to circumscribe ball 10 in the same manner that rules are formed on the face of a clock. Each reference rule 71 in FIG. 1 has an associated "time" number which would on the face of a clock, indicate the time of day. Each reference rule 11 and its associated "time" number are included in FIG. 1 only for purposes of reference and for describing the use of ball 10 and ordinarily are not inscribed on ball 10 When ball 10 is in a fixed position (i.e., when the ball is setting on a batting-T or when the ball is being looked at at the instant it is being hit), the location of points or areas which are on the periphery of body 30 and lie in the horizontally oriented reference plane which passes through axis 20 and is parallel to the plane of the sheet of paper of FIG. 1 can be identified using the reference rules 71 and their associated "time" number.

Each reference rule 71 and its associated "time" number can also be utilized to identify a location to which portion 40 is moved when ball 10 is rotated about axis 15. If, in FIG. 1, ball 10 is rotated about axis 15, then, during such rotation about axis 15, arm 12 moves in and stays in a horizontally oriented reference plane (not shown for sake of clarity) which passes through axis 20 and which is parallel to and lies in the plane of the sheet of paper of the drawing in FIG. 1. In FIG. 2, this horizontally oriented reference plane also passes through axis 20 but is normal to the plane of the sheet of paper of the drawing.

In explaining the utilization of ball 10 in accordance with the invention, the hitter 13 in FIG. 1 and the hitter referenced in FIG. 4 are each assumed to be right-handed hitters. Similar principles can be readily applied to left hand hitters. As shown in FIG. 1, the twelve o'clock (12:00) position (indicated by the combination of a rule line 71 and its associated "time" number "12" in FIG. 1) is closest to hitter 13. The three o'clock (3:00) position is closest to the pitcher's mound. The six o'clock position is, of all the positions 1:00, 2:00, 3:00 . . . 12:00, furthest from the hitter 13. As will be described, when a batter hits ball 10, it typically is preferred that the bat contact the ball at either about the 9:00 or 10:00 position and that the hitter not attempt to "hit around" the ball by contacting, for example, the 8:00 position on the side of ball 10 which is away from the hitter.

In FIG. 1, portion 40 is at the 9:00 position. Portion 40 can be moved to 10:00, 11:00, 11:40, etc. simply by rotating ball 10 about vertical axis 15. When portion 40 is at the position indicated by dashed lines 12A, it is in the 10:00 position. As noted, regardless of the position 9:00, 10:20, 1:10, etc. to which portion 40 is moved by rotating body 30 about axis 15, portion 40 presently preferably remains in the horizontally oriented reference plane which passes through axis 20 and is parallel to and lies in the plane of the sheet of paper of the drawings in FIG. 1. It is understood, however, that in learning to hit a ball, a teaching technique may require the rotation of body 30 and portion 40 in either one or both of a horizontal reference plane like said horizontal reference plane passing through axis 20 in FIG. 1 and a vertical reference plane which is normal to the horizontal reference plane, i.e., body 30 can be rotated such that portion 40 is moved or tilted upwardly or downwardly from the horizontal reference plane passing through axis 20 in FIG. 1.

In one technique for learning how to hit a baseball, it is preferred that during an inside pitch from a pitcher a batter learns to hit a ball 10A when the ball 10A is, as shown in FIG. 3, about three to five inches in front of the leading edge 23 of home plate 22; it is preferred that during a down-the-middle pitch from a pitcher a batter learns to hit a ball 10B when the ball 10B is, as shown in FIG. 3, at and over the leading edge 23 of home plate 22; and, it is preferred that during an outside pitch from a pitcher, a batter learns to hit a ball 10C when the ball 10C is, as shown in FIG. 3, at and over the outside corner of home plate 22 where edge 24 of plate 22 intersects edge 25 of plate 22. This technique for learning how to hit a baseball also requires that a ball be hit at about the nine o'clock (9:00) position when hitting a ball 10A during an inside pitch or when hitting a ball 10B during a pitch down-the-middle of the plate. During an outside pitch, a baseball is hit at about the ten o'clock position. The baseballs 10A, 10B, 10C illustrated in FIG. 3 are ordinary baseballs of the type utilized in little league and major league baseball and are not practice baseballs constructred in accordance with the invention.

In order to practice hitting an inside pitch, a batting-T 16 is used. The batting-T 16 includes vertically oriented telescoping arm 16A fixedly connected to base 16B. The batting-T 16 is positioned with respect to plate 22 such that arm 16A is positioned three to five inches in front of leading edge 23 on the inside of plate 22 so that a ball 10 can be set on top of arm 16A in the manner shown in FIG. 4 and so that the ball 10 will be positioned in front of and on the inside of plate 22 in a position comparable to the position of ball 1OA in FIG. 3. The length of arm 16A can be adjusted as desired. The ball 10 is then oriented in the manner shown in FIGS. 1, 2, and 4 such that arm 12 lies in a horizontal plane which passes through axis 20 and is parallel to the ground (and parallel to the plane of the sheet of paper of the drawing in FIG. 1) and such that portion 40 is in the nine o'clock position illustrated in FIG. 1. If, in FIG. 4, ball 10 is rotated about vertical axis 15 to move portion 40 from a 9:00 position to the 10:00 position, such rotation of ball 10 tends to make portion 40 point more directly at the batter 17. If, in FIG. 4, ball 10 is rotated about vertical axis 15 to move portion 40 from a 9:00 position to the 8:00 position, such rotation of ball 10 tends to make portion 40 point more away from the batter 17. After portion 40 is in the nine o'clock position, the batter 17 swings bat 50 and attempts to hit portion 40 and drive portion 40 into body 30. If the batter 17 does squarely hit portion 40 during a normal swing of bat 50, bat 50 ordinarily will drive portion 40 completely into body 30 and opening 14. After the hitter 17 strikes ball 10 with bat 50, the ball 10 is retrieved and is examined to determine if portion 40 is driven into body 30. If portion 40 is driven into body 30, then batter 17 struck the surface of ball 10 at the desired location. If portion 40 is not driven into body 30, then batter 17 did not strike ball 10 at the desired location.

In order to practice hitting a pitch down-the-middle, batting-T 16 is used. The batting-T 16 is positioned with respect to plate 22 such that arm 16A is positioned at the middle of leading edge 23 of plate 22 so that a ball 10 can be set on top of arm 16A in the manner shown in FIG. 4 and so that the ball 10 will be positioned at the front middle of plate 22 in a position comparable to the position of ball 10B in FIG. 3. The length of arm 16A can be adjusted as desired. The ball 10 is then oriented in the manner shown in FIGS. 1, 2, and 4 such that arm 12 lies in a horizontal plane passing through axis 20 and parallel to the ground (and parallel to the plane of the sheet of paper of the drawing in FIG. 1) and such that portion 40 is oriented in the nine o'clock position illustrated in FIG. 1. The batter 17 then swings bat 50 and attempts to hit portion 40 and drive portion 40 into body 30. If the batter 17 does squarely hit portion 40 during a normal swing of bat 50, bat 50 ordinarily will drive portion 40 completely into body 30 and opening 14. After the hitter 17 strikes ball 10 with bat 50, the ball 10 is retrieved and is examined to determine if portion 40 was driven into body 30. If portion 40 is driven into body 30, then batter 17 struck the surface of ball 10 at the desired location. If portion 40 is not driven into body 30, then batter 17 did not strike ball 10 at the desired location.

In order to practice hitting an outside pitch, batting-T 16 is used. The batting-T 16 is positioned with respect to plate 22 such that arm 16A is positioned at the junction of the edges 24 and 25 of plate 22 so that a ball 10 can be set on top of arm 16A in the manner shown in FIG. 4 and so that the ball will be positioned at the outside corner of plate 22 in a position comparable to the position of ball 10C in FIG. 3. The ball 10 is then oriented in the manner shown in FIGS. 1, 2, and 4 such that arm 12 lies in a horizontal plane passing through axis 20 and parallel to the ground (and parallel to the plane of the sheet of paper of the drawing in FIG. 1) and such that portion 40 is oriented in the ten o'clock position illustrated by dashed lines 12A in FIG. 1. The batter 17 then swings bat 50 and attempts to hit portion 40 and drive portion 40 into body 30. If the batter 17 does hit squarely portion 40 during a normal swing of bat 50, bat 50 will drive portion 40 into body 30. After the hitter 17 strikes ball 10 with bat 50, the ball 10 is retrieved and is examined to determine if portion 40 is driven into body 30. If portion 40 is driven into body 30, then batter 17 struck the surface of ball 10 at the desired location. If portion 40 is not driven into body 30, then batter 17 did not strike ball 10 at the desired location.

In FIG. 3, reference character 18 identifies the left foot of a right handed batter. Reference character 19 identifies the right foot of a right handed batter. When the right handed batter is standing in the batter's box 21, the left foot 18 is closer to the pitcher than the right foot 19. Right foot 19 is in the "back" of the batter's box in FIG. 3. The preferred position of a ball 10B (or 10A or 10C) when it is hit by a batter can, without reference to home plate 22, be defined utilizing coordinates D1 and D2 which lie in a reference plane (not shown) that is parallel to the ground and which define the position of ball 10B with respect to the foot 18 of a batter.

In FIG. 4, batter 17 hits ball 10 in the direction generally indicated by arrow B and also attempts to squarely hit portion 40 to drive arm 12 into body 30 and into opening 14 in the direction of arrow B.

In another embodiment of the invention, arm 12 is, prior to ball 10 being struck by a hitter 17, positioned in cylindrical opening 14 such that the circular end surface 60 of portion 40 is generally flush with or recessed from the outer spherical surface of body 30 and the circular aperture 51. The outer spherical surface of body 30 and cylindrical opening 14 co-terminate at circular aperture 51 and at circular aperture 52. In FIG. 2, dashed line 60A indicates the position of circular end surface 60 slightly recessed in opening 14. When end surface 60 is flush with the outer spherical surface of body 30, striking ball 10 at the circular aperture 51 with a bat 50 ordinarily displaces arm 12 either because bat 50 directly contacts end surface 60 regardless of whether ball 10 is compressed by bat 50, or because ball 10 is compressed by bat 50 and permits bat 50 to contact end surface 60 and displace arm 12 in opening 14. When arm 12 is, prior to ball 10 being struck by a batter 17, positioned in opening 14 such that end surface 60 is flush with or is slightly recessed from the spherical outer surface of body 30, arm 12 can be shaped and dimensioned such that the other end 53 of arm 12 extends out of circular aperture 52 or is completely housed inside of opening 14, as desired. When end surface 60 is recessed in cylindrical opening 14 prior to ball 10 being struck with a bat 50, it is preferred that the distance between end surface 60 and circular aperture 51 not be too great, otherwise it is not, practically speaking, possible for a batter to strike ball 10 with bat 50 hard enough to compress body 30 an amount sufficient for bat 50 to strike end surface 60 and displace arm 12 in opening 14. One advantage of positioning end surface 60 flush with or recessed from the outer spherical surface of body 30 is that ball 10 is less of a safety hazard because a portion 40 of arm 12 no longer extends outwardly from body 30.

Having described my invention in such terms as to enable those skilled in the art to understand and practice it, and having identified the presently preferred embodiments thereof, I claim:

I claim:

1. A practice ball for enabling an individual contacting said ball with a striking instrument to determine whether the striking instrument contacts said ball at a desired location, said practice ball including (a) a spherically shaped body; and, (b) at least one arm mounted on said body and moveable between at least two operative positions (i) a first operative position with at least a portion of said arm extending outwardly from said body, and (ii) a second operative position different from said first operative position with said arm displaced from said first operative position, said arm (iii) being displaced from said first to said second operative position by hitting said portion of said arm with said striking instrument, and (iv) after being hit with said striking instrument, remaining in said second operative position to permit confirmation that said arm was hit with said striking instrument and moved from said first to said second operative position.

2. A practice ball for enabling an individual contacting said ball with a striking instrument to determine whether the striking instrument contacts said ball at a desired location, said practice ball including (a) a body having a spherical shape and dimension; and, (b) at least one arm mounted on said body and moveable between at least two operative positions, (i) a first operative position, and (ii) a second operative position different from said first operative position with said arm displaced from said first operative position, said arm being displaced from said first to said second operative position by hitting said arm with said striking instrument, said body remaining intact and retaining said spherical shape and dimension after said arm is hit with said striking instrument; and, (c) means for determining that said arm has moved from said first to said second operative position.

3. A method for practicing hitting a ball, said method including the steps of (a) providing a practice ball including (i) a spherically shaped body; and, (ii) at least one arm mounted on said body and moveable between at least two operative positions, a first operative position, and a second operative position different from said first operative position;

(b) providing a striking instrument for hitting said practice ball, said arm (i) being displaced from said first to said second operative position by hitting said arm with said striking instrument, and (ii) after being hit with said striking instrument, remaining in said second operative position to permit confirmation that said arm was hit with said striking instrument and moved from said first to said second operative position;

(c) placing said practice ball in a fixed position with said arm is said first operative position;

(d) hitting said practice ball with said striking instrument while attempting to hit said arm with said striking instrument; and, (e) after hitting said practice ball with said striking instrument, examining said practice ball to determine if said arm is in said second operative position.

4. The method of claim 3 wherein in step (c) said ball is placed in a fixed position such that said arm is generally parallel to the ground and is at the 9:00 position.

5. The method of claim 3 wherein in step (d) said ball is placed in a fixed position such that said arm is generally parallel to the ground and is at the 10:00 position.

6. The method of claim 3 wherein in step (d), (a) to practice hitting a down-the-middle pitch said ball is placed in a first fixed position such that said arm is generally parallel to the ground;

(b) to practice hitting an inside pitch said ball is placed in a second fixed position different from said first fixed position such that said arm is generally parallel to the ground; and, (c) to practice hitting an outside pitch said ball is placed in a third fixed position different from said first and second fixed positions such that said arm is generally parallel to the ground.

7. The method of claim 3 including (a) between steps (b) and (c) the additional steps of (i) providing a batter's box; and, (ii) providing a plate having a leading edge (23) and an outside corner.

8. The method of claim 7 wherein in step (d), (a) to practice hitting a down-the-middle pitch said ball is placed in a first fixed position above the ground and over the middle of said leading edge (23) of said plate such that said arm is generally parallel to the ground;

(b) to practice hitting an inside pitch said ball is placed in a second fixed position above the ground and forwardly of said leading edge (23) of said plate such that said arm is generally parallel to the ground; and, (c) to practice hitting an outside pitch said ball is placed in a third fixed position above the ground and rearwardly of said leading edge (23) of said plate such that said arm is generally parallel to the ground.

9. The method of claim 8 wherein in said third fixed position said ball is over said outside corner of said plate.

10. A method for practicing hitting a ball, said method including the steps of (a) providing a practice ball including (i) a body having a spherical shape and dimension and having a selected contact area, and, (ii) contact means for determining when said selected contact area has been hit;

(b) providing a striking instrument for hitting said practice ball on said selected contact area;

(c) placing said practice ball in a fixed position with said contact area in a selected position;

(d) hitting said practice ball with said striking instrument while attempting to hit said contact area, said body retaining said spherical shape and dimension after said practice ball is hit with said striking instrument; and, (e) utilizing said contact means to determine if said contact area was hit with said striking instrument.

11. The method of claim 10 wherein in step (c) said ball is placed in a fixed position such that said contact area is at the 9:00 position.

12. The method of claim 10 wherein in step (d) said ball is placed in a fixed position such that said contact area is at the 10:00 position.

13. The method of claim 10 wherein in step (d), (a) to practice hitting a down-the-middle pitch said ball is placed in a first fixed position such that said contact area faces rearwardly from the direction of travel (B) of said ball when said ball is hit with said striking instrument;

(b) to practice hitting an inside pitch said ball is placed in a second fixed position different from said first fixed position such that said contact area faces rearwardly from the direction of travel (B) of said ball when said ball is hit with said striking instrument; and, (c) to practice hitting an outside pitch said ball is placed in a third fixed position different from said first and second fixed positions such that said contact area faces rearwardly from the direction of travel (B) of said ball when said ball is hit with said striking instrument.

14. The method of claim 10 including (a) between steps (b) and (c) the additional steps of (i) providing a batter's box; and, (ii) providing a plate having a leading edge (23) and an outside corner.

15. The method of claim 14 wherein in step (d), (a) to practice hitting a down-the-middle pitch said ball is placed in a first fixed position above the ground and over the middle of said leading edge (23) of said plate such that said contact area faces rearwardly from the direction of travel of said ball when hit by said striking instrument;

(b) to practice hitting an inside pitch said ball is placed in a second fixed position above the ground and forwardly of said leading edge (23) of said plate such that said contact area faces rearwardly from the direction of travel of said ball when hit by said striking instrument; and, (c) to practice hitting an outside pitch said ball is placed in a third fixed position above the ground and rearwardly of said leading edge (23) of said plate such that said contact area faces rearwardly from the direction of travel of said ball when hit by said striking instrument.

16. The method of claim 15 wherein in said third fixed position said ball is over said outside corner of said plate.

* * * * *